United States Patent [19]

Oppenheimer

[11] 4,453,716

[45] Jun. 12, 1984

[54] TRANSVERSE FORCE INDICATING DEVICE FOR SWING TEACHING

[76] Inventor: Jess Oppenheimer, 549 Moreno Ave., Los Angeles, Calif. 90049

[21] Appl. No.: 314,147

[22] Filed: Oct. 23, 1981

[51] Int. Cl.[3] ..... A63B 69/36

[52] U.S. Cl. ..... 273/186 A; 273/193 B

[58] Field of Search ..... 273/186 A, 193 B, 80 B, 273/186 R

[56] References Cited

U.S. PATENT DOCUMENTS

| | | | |
|---|---|---|---|
| 1,990,281 | 2/1935 | Grelle | 273/186 A |
| 2,158,211 | 5/1939 | Aitken | 273/193 B X |
| 2,593,822 | 4/1952 | Wendt et al. | 273/193 B |
| 3,206,205 | 9/1965 | McLoughlin | 273/80 B |
| 3,317,211 | 5/1967 | Debski | 273/193 B X |
| 3,792,863 | 2/1974 | Evans | 273/186 A |
| 4,211,418 | 7/1980 | Oppenheimer | 273/186 R |

*Primary Examiner*—George J. Marlo

*Attorney, Agent, or Firm*—Nilsson, Robbins, Dalgarn, Berliner, Carson & Wurst

[57] ABSTRACT

A transverse force indicating device for assisting in the teaching of a smooth swing for a golf club or other rod-like object includes a joint apparatus interconnecting bifurcated guide rods on a swing teaching apparatus or a bifurcated club, club extension, or attachment member. The joint apparatus may be a balsa wood dowel interconnecting the bifurcated first and second rod members or may be a ball and socket arrangement which has a spring or other suitable locking device to maintain a coaxial orientation of the first and second rod members unless the transverse shear force exerted by or against the first rod member during a swing of the club by a user is greater than a predefined amount. The wood dowel is designed to break as a sole consequence of swinging the club, if the club swing is not properly executed. Alternatively, a strain gauge arrangement with a meter readout may be employed to provide a reading of the amount of transverse force being exerted by the user.

2 Claims, 13 Drawing Figures

FIG. 1
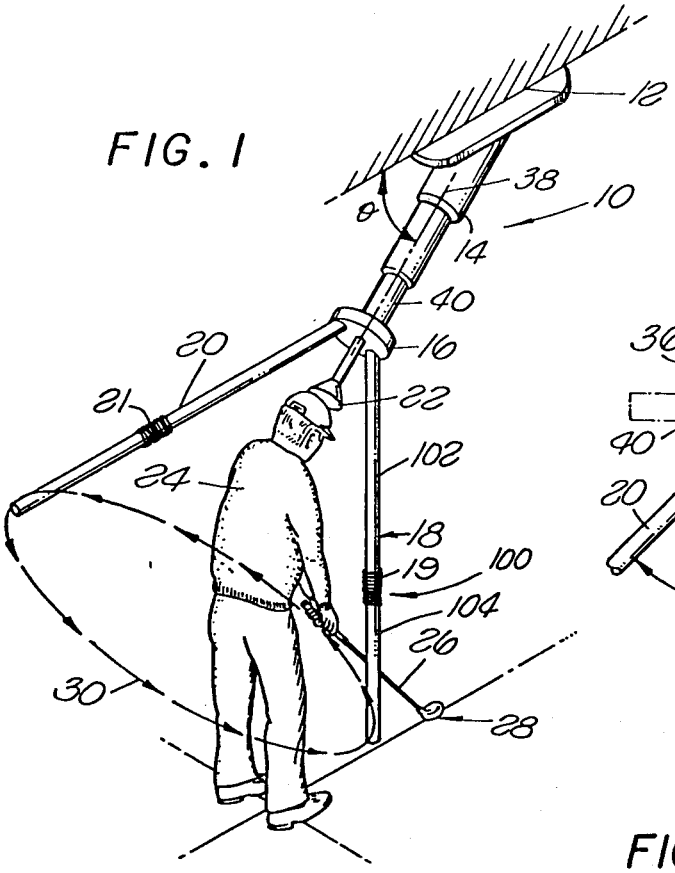
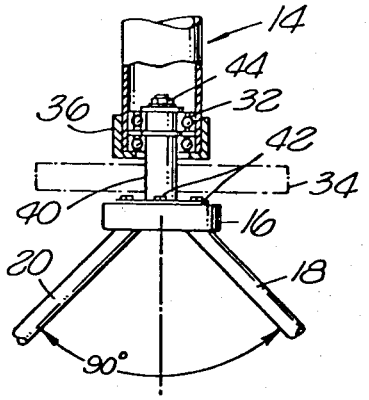
FIG. 3
FIG. 2
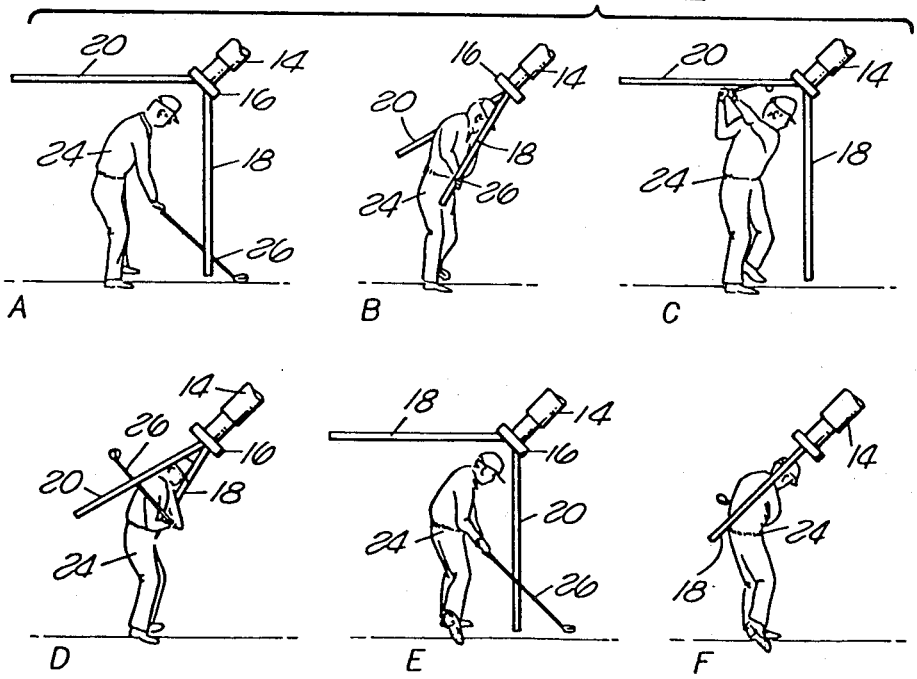

FIG. 4
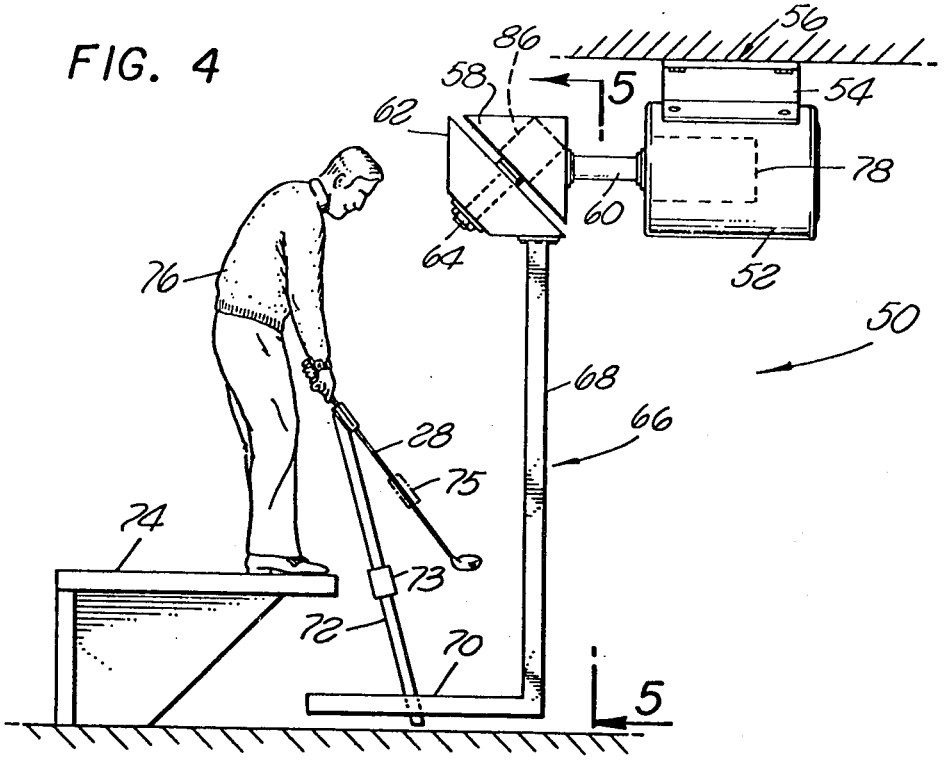
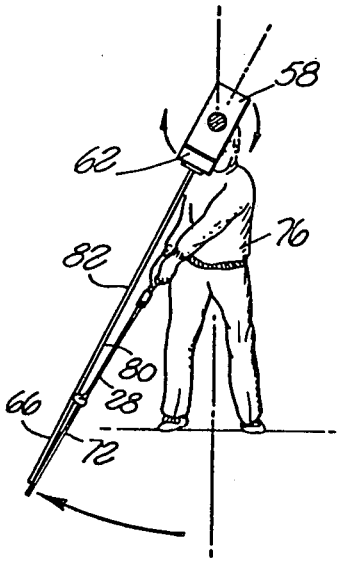
FIG. 5A
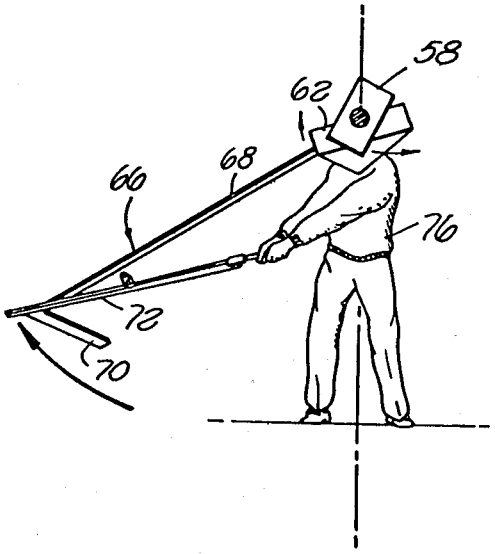
FIG. 5B

TRANSVERSE FORCE INDICATING DEVICE FOR SWING TEACHING

BACKGROUND OF THE INVENTION

The present invention relates to an indicating device and, in particular, to an indicating device which indicates the amount of transverse shear force exerted as a club or bat is swung prior to hitting a ball or other object so that a user can adjust the speed of the swing to obtain optimal results.

The transverse force indicating device in accordance with the present invention, may be utilized for teaching the user how to swing any rod-like object through an arcuate path. However, for purposes of illustration, the transverse force indicating device is described in a configuration useful in teaching a golfer how to swing a golf club through a preferred arcuate swing path using a suitable swing teaching apparatus such as that disclosed in U.S. Pat. Nos. 4,268,035 and 4,211,418.

In the swinging of any rod-like object, such as a golf club or baseball bat, it is essential that the object be swung through a proper arcuate path in order that the maximum power and timing be achieved so that a ball or the like will be propelled with both power and accuracy. However, a loss of control and timing frequently occurs when a golfer tries to exert too much force to hit the ball. Indeed, maximum power is delivered to a ball not by the exertion of maximum force throughout the stroke, but rather by a smooth, continuously accelerating swing, where the force is applied continuously rather than in a discontinuous or jerky manner.

Numerous devices have been developed to guide the rod-like object through the proper arcuate path to enable the user to acquire the "feel" of a proper swing so that, with practice, a desired swing will be achieved without requiring the use of the swing teaching apparatus. Patents disclosing examples of such swing teaching apparatus include:

| U.S. Pat. No. | Inventor | Date |
|---|---|---|
| 2,448,905 | Milner | 9/7/48 |
| 2,655,378 | Sheffer | 10/13/53 |
| 3,400,933 | Heiser | 9/10/68 |
| 4,047,605 | Rosenvold | 9/13/77 |

In each of the above patents, the device is, in one way or another, attached to the golf club. The swing teaching apparatus in application Ser. No. 10,554 , now U.S. Pat. No. 4,211,418, is not attached to the golf club as in the above patents and hence allows the user to "feel" the proper swing direction and thus be able to guide the club through the predefined arcuate path. The guiding is achieved by making it easier to rotate the swing teaching device when the golf club is swung through the predefined arcuate path. Because the user learns the proper swing by feeling it, rather than being constrained to it, it is believed that the transition to not using the teaching device, but still maintaining a proper swing, will be more quickly and easily made.

An implicit requirement of any teaching apparatus intended to teach swing control and timing as distinguished from swing position is that the golf club's weight distribution and balance be substantially the same whether or not the teaching apparatus is incorporated. Without the same weight distribution and balance the "feel" of the swing will be affected by the teaching apparatus. Attempts to duplicate that "feel" using a club without the teaching apparatus will then result in an incorrect swing making the teaching apparatus useless or even harmful in teaching correct swing timing and control.

While the swing teaching apparatus in U.S. Pat. Nos. 4,211,418 and 4,268,035 are thus valuable in teaching the proper swing direction, it does not indicate the amount of transverse force which the user is exerting against it. Hence, the swing may be in a proper arc but may still be improper and suboptional because it is jerky and discontinuous.

The present invention incorporates a transverse force indicating means whereby the force with which the club presses against the guide rod is indicated and thus can be applied more smoothly and continuously by the user. The transverse force indicating means may comprise a bifurcated member which may be the guide rod of the swing teaching apparatus or the club or attachment to the club where the bifurcated member comprises two parts interconnected in a normal coaxial configuration by a hinging device or a weak connecting member. If the club or club attachment exerts a transverse force greater than a predefined magnitude against the swing teaching machine guide rod, one part of the bifurcated member will bend out of coaxial alignment about the hinging device or will break off from the other member at the weak connecting member. Alternatively, the transverse force indicating means may be a strain gauge arrangement positioned on the guide rod, club or club attachment with a readout device interconnected to the strain gauge arrangement. The readout device is then calibrated and positioned so that the user can obtain a continuous feedback of the magnitude of the force exerted by the user. The user can then modify his swing until the exerted force remains within a specified value or satisfies some other predefined criteria.

In the preferred embodiment of the invention, the transverse force indicating means is configured to be responsive to a transverse force applied from any direction transverse to the common longitudinal axis of the two parts of the bifurcated member.

Of course, it will be appreciated that the transverse force may be applied without the necessity that the club or other device being swung by a user come in contact with an object such as the aforementioned swing teaching apparatus. Thus, in accordance with one embodiment of the invention, the club shaft to be swung may be bifurcated into first and second parts with an appropriate interconnecting apparatus therebetween to maintain a normal coaxial alignment. As the club accelerates through a swing, transverse forces are applied along the length of the bifurcated club shaft. If the relative transverse force between the two parts of the shaft caused by this acceleration through a swing is greater than a predefined amount, the two parts of the shaft will bend relative to each other.

In accordance with another embodiment of the invention, one or more strain gauge sensors may be positioned at a location along the shaft and may preferably be of a configuration which will measure the transverse force regardless of the direction along which force is applied so long as it is a transverse force.

SUMMARY OF THE INVENTION

The present invention comprises an unattached swing teaching apparatus rotatable through a predefined arcuate path where the swing teaching apparatus comprises a support means, rotating means which is rotatably attached to and supported by the support means, a guide rod means fixed for rotating with the rotating means and a generally rod-like object for being swung. The guide rod means is positioned for being intermittently contacted and rotated by the object as the object is swung for guiding the object through the predefined arcuate path. Finally, means are provided for indicating the amount of transverse force exerted by the object against the guide rod means when the object is swung in contacting relationship with the guide rod means.

In one embodiment, the guide rod means comprises at least one dual sectioned rod having a first and a second section, where the first section is positioned for being contacted by the object as the object is swung. In addition, the transverse force indicating means comprises a hinge apparatus interconnecting the first and second sections for maintaining the first and second sections in a normally coaxial orientation. The first section is then provided to bend relative to the second section only when the transverse force applied by the object against the first section exceeds a predefined magnitude.

In another embodiment, the object comprises a dual sectioned rod having a first section and a second section where the first section is positioned for contacting the guide rod means. The transverse force indicating means comprises a hinge apparatus as before but interconnecting the first and second sections of the object (rather than the guide rod) in a normally coaxial orientation whereby the first section bends relative to the second section only when the transverse force applied by the first section against the guide rod means exceeds a predefined magnitude.

In still another embodiment a shear member may replace the hinge apparatus so that the shear member shears causing the first section to separate from the second section when the transverse force applied by the object against the first section exceeds a predefined value.

In yet another embodiment, the dual section object or dual section guide rod is replaced by a single unitary guide rod or object and a sensor means is attached to either the object or the guide rod for sensing the amount of bending strain, which is proportional to the applied transverse force, along the object or guide rod when the object is swung. A meter may then be electrically coupled to the sensor for measuring the amount of bending strain and displaying the measured value of the bending strain to a user.

It will be appreciated that the transverse force indicating means may be interconnected to the shaft of a golf club itself without departing from the invention.

BRIEF DESCRIPTION OF THE DRAWINGS

The invention will be better understood from the detailed description below taken in conjunction with the drawings wherein like reference characters refer to like parts throughout and in which:

FIG. 1 is a perspective view of one embodiment of the swing teaching apparatus having a transverse force indicating device attached to a guide rod;

FIGS. 2A–2F is a sequence illustrative of the operation of the unattached swing teaching apparatus of FIG. 1;

FIG. 3 is a partial cut-away plan view of the unattached swing apparatus of FIG. 1 showing the bearing by which the shaft or axle is attached to the support means;

FIG. 4 is a side plan view of a second embodiment of the present invention;

FIGS. 5A–5F is a sequence illustrative of the various operation positions of the unattached swing teaching apparatus of FIG. 4;

DETAILED DESCRIPTION

Figure 5C:
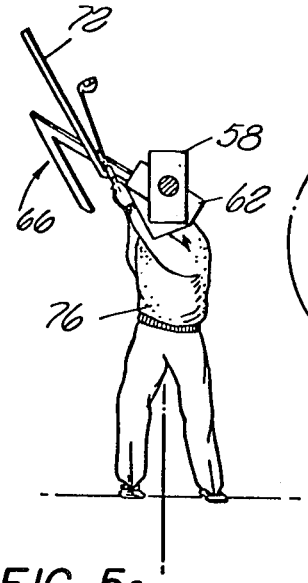

One embodiment of an unattached swing teaching apparatus 10 is illustrated in FIG. 1 and comprises a support member 14 fixed to a solid surface 12, such as a wall or ceiling. A shaft 40 is rotatably coupled to the stationary support member 14 to rotate about a longitudinal axis 38 which is preferably the central axis of the support member 14. Guide rod means, comprising a first guide rod 18 and a second guide rod 20, are fixedly attached to a plate member 16 fixed to the end of the shaft 40 to rotate therewith. The guide rods 18 and 20 may be positioned at any selected projected angle relative to each other in the plane perpendicular to the axis of rotation, i.e. the axis 38.

A head positioning means 22 may optionally be attached to the plate 16 or may extend through the center of the plate 16 and be attached to the support member 14 and fixed thereto. The head positioning means 22 may be attached either to the plate 16 or to the cylindrical member 14 in such a way that the portion of the head positioning means 22 which engages the head of a user 24 will be stationary relative to the rotating means comprising the shaft 40, the plate 16 and the guide rods 18 and 20. Alternatively, the head positioning means may be placed on the ground behind the user to extend up over the user's head without interfering with the rods.

The supporting wall or ceiling 12 is illustrated as generally parallel to the surface upon which the user 24 stands. The support member 14 is then attached to extend downward at an angle $\theta$ which is preferably 45°. The first guide rod 18 and the second guide rod 20 are then fixed to the plate 16 at opposing 45° angles. If, as is preferred, the guide rod 18 and the guide rod 20 are substantially equal length, as the guide rods rotate, their ends will follow a circular path 30 in a plane which is at a 45° angle relative to the ground and which is perpendicular to the longitudinal axis 38.

Referring to FIG. 3, a cross sectional detail of one illustrative means by which the shaft 40 is rotatably attached to the support member 14 is shown. More specifically, the plate 16 is attached to the end of the rotatable shaft 40 by, for example, a plurality of bolts 42. A bearing apparatus 32 is then positioned in the interior of the support member 14, which is illustrated to be a hollow cylinder, and is held in place by an end cap 36. A nut 44 is then placed on the end of the shaft 40 to hold the bearing 32 to the opposite end of the shaft 40.

In an alternative embodiment of the present invention, a means for providing resistance to the swinging of the unattached swing teaching apparatus 10 is illustrated for use in developing the strength of the user or to facilitate slow motion analysis of a user's swing for teaching purposes. For example, the means for providing resistance may be a cylindrical plate 34 which acts as a load to provide resistance to the rotation of the shaft 40. Alternatively, the nut 44 may be tightened or loosened to provide more or less bearing friction and thereby provide more or less resistance to rotation of the shaft 40.

A means 19 for indicating the amount of transverse force exerted by the shaft 26 or other similar object being swung by the user, may be positioned at a point along the guide rod 18. A similar means 21 for indicating the amount of transverse force exerted by the shaft 26 against the guide rod 20 may also be positioned along the guide rod 20. In the preferred embodiment, the transverse force indicating means 19 and 21 are positioned at a central location along the guide rods 18 and 20, respectively, between the point at which the transverse force is applied to the guide rod by the shaft 26, and the plate 16.

Figure 6:
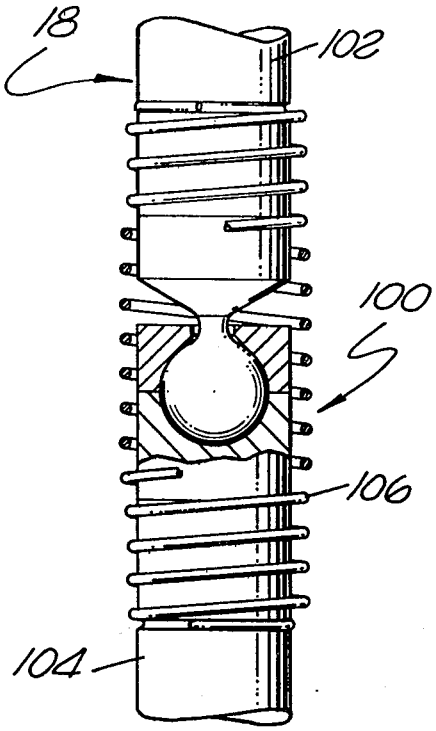
FIG. 6 is a multidirectional hinge apparatus attached to a bifurcated rod which may be the guide rod, the object, an attachment to the object which is to be swung, or an extension of a body part.
Figure 7:
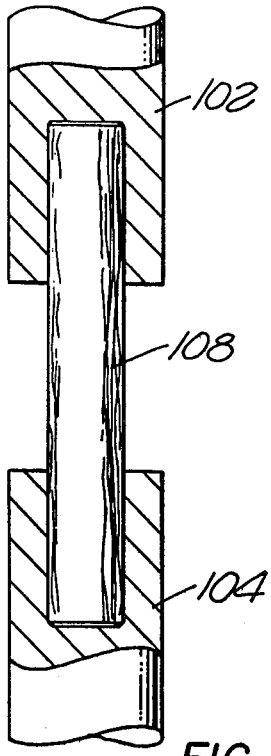
FIG. 7 illustrates a bifurcated rod as in FIG. 6 but which is interconnected by a shear member.
Figure 8:
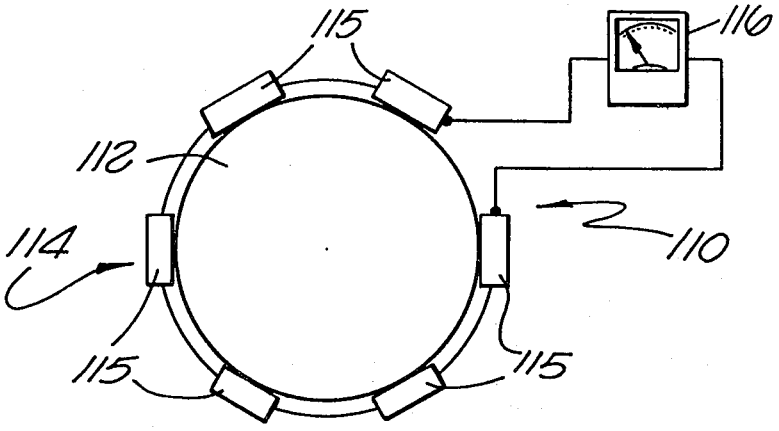
FIG. 8 illustrates an embodiment of the invention where the means for indicating the amount of transverse force is a strain gauge and display meter.

Referring more particularly to FIGS. 6, 7 and 8, specific embodiments of the transverse force indicating means are illustrated. For example, in one embodiment, the transverse force indicating means 19 and 21 may comprise a ball and socket type hinge apparatus 100 interconnecting a first section 102 and a second section 104 of a guide rod, such as the guide rod 18 or 20, which is bifurcated into the above-described first and second sections. In the embodiment of FIG. 6, the two bifurcated sections 102 and 104 are interconnected by the hinge apparatus 100 which is configured, by use of a spring or other conventional mechanical arrangement, to maintain the first section 102 in normally coaxial alignment with the second section 104.

In operation, the transverse force applied by the club or other object to be swung is applied against the first section 102 with the second section 104 being interconnected to the rotating means such as the plate apparatus 16 shown in FIG. 1. A coil spring 106 is positioned around the hinge apparatus and adjoining portions of the first and second sections 102 and 104 to hinder bending of the first section 102 relative to the second section 104 and hence maintain the first section 102 and the second section 104 is coaxial alignment unless the transverse force applied to the first section 102 by the object being swung, exceeds a predefined magnitude. The maximum transverse force which can be applied without causing bending about the hinge can be varied by varying the size or structure of the coil spring 106 to apply a greater or lesser amount of force resisting the bending of the hinge apparatus 100. Of course, any other suitable hinging apparatus may be used without departing from the invention.

An alternative embodiment of the invention is illustrated in FIG. 7 where the hinge apparatus of FIG. 6 is replaced by a shear member 108. The shear member may, for example, be simply a balsa wood dowel which is inserted into an orifice in the end of the second section 104 and into an orifice in the end of the first section 102 to thereby interconnect the first and second sections 102 and 104 with the balsa wood shear member 108. In operation, the shear strength of the balsa wood dowel is less than the shear strength of the first and second members 102 or 104. Consequently, if the transverse force applied against the first section 102 is greater than the force required to break the balsa wood dowel, then the first section 102 will separate from the second section 104. Thus, the maximum transverse force may be varied by, for example, varying the diameter of the balsa wood dowel. Of course, suitable means such as a connecting strap or the like may be provided to protect the user from being struck by the first section when it separates. In order to reposition the first section and second section in coaxial alignment after the first section has separated from the second section, it is merely necessary to remove the broken balsa wood dowel from the orifice in the first and second sections and replace it with a new one.

Of course, any such interconnection device must not substantially alter the weight distribution or balance of the golf club since substantial alterations will change the optimum swing control and timing sought to be taught.

Another means for indicating the amount of transverse force in accordance with the invention is illustrated in FIG. 8 wherein a strain gauge apparatus 110 is utilized. It will be appreciated that in this embodiment the guide rods are not bifurcated but rather a strain gauge sensor device 114, preferably comprising several strain gauges 115 connected in series, is attached to the surface of a rod 112 about its circumference. The strain gauge sensor members 115 may, for example, be the indicating devices 19 and 21 on the guide rods shown in FIG. 1, the indicating device 73 of the shaft extension member 72 shown in FIG. 4, or the indicating device 75 attached to the golf club itself as shown in phantom in FIG. 4. If the transverse force indicating means 19 and 21 both comprise the strain gauge device illustrated in FIG. 8, then a separate strain gauge sensor device 114 is placed on the surface of each of the guide rods 18 and 20. The strain gauges may then be interconnected in series with a meter device such as a meter 116.

In operation, the meter 116 is positioned so that the user of the device can observe the meter reading throughout the duration of his swing. Thus, the user can continuously adjust the amount of force which he is applying against the guide rods during his swing so that the reading on the meter 116 does not exceed a predefined value or otherwise meets some suitable criteria. Of course, it will be appreciated that any suitable strain gauge device may be utilized and that such strain gauges are well known in the art. Illustrative strain gauge devices are discussed in Van Nostrand's Scientific Encyclopedia, Fifth Edition, published 1976, at page 2100.

The above described hinge apparatus, shear member and strain gauge apparatus comprising the transverse force indicating means may be used in conjunction with a swing teaching apparatus as part of the guide rods, as part of the club extension member or as a part of the club itself. In addition, it will be appreciated that the transverse force indicating apparatus of the present invention may be incorporated as part of the club itself without the need for a separate swing teaching machine as is herein described. In this latter embodiment the transverse force results from the transverse bending strain inherent as the club accelerates through a swing even though the club is not in contact with a guide rod of a swing teaching apparatus. As such, the transverse forces exerted against the upper part of the club as the club swings through an arc will be different from the transverse forces exerted against the lower part of the club as a consequence of swinging the club. If that differential in transverse force is sufficiently large due to a sufficiently high acceleration (for example when the swing is jerky rather than smooth), the interconnection means will cause the lower part of the club to bend or otherwise break away from the upper part of the club.

It will also be appreciated that while the transverse force indicating device may be configured to indicate the transverse force exerted in only one transverse direction as with a dual motion hinge or a single strain gauge portion at only one location about the periphery of the shaft, it is preferred that the transverse force indicating means be multidirectional as with the ball and socket hinge of FIG. 6 or the strain gauge device of FIG. 8. Such a multidirectional arrangement allows the transverse force to be indicated even though the transverse direction at which the force occurs changes throughout the swing.

The operation of the unattached swing teaching apparatus may be described with reference to FIGS. 2A through 2F which illustrate various positions of the swing teaching apparatus at corresponding positions of the swing of a golfer. While the present invention is particularly applicable to teaching of a golf swing, it will be appreciated that the present invention may be utilized to guide any rod-like object such as a baseball bat, which is to be swung by a user.

The golfer 24 commences his back swing by pushing against the guide rod 18 with the shaft 26, thereby causing the guide rod 18, the guide rod 20, the plate 16 and the shaft 40 to commence rotational motion. At address, the club shaft 26 bears against the rod 18 at a point which is near the end of the rod and also near the clubhead end of the golf club 28. As the back swing continues, the point of contact between the shaft of the club 26 and the rod 18 gradually changes until at the top of the back swing, the bearing point between the rod 18 and the club shaft 26 is near the grip end of the club and near the end of the rod nearest to the plate 16. Thus, even though the apparatus and the club shaft are each continually moving and changing directions and angles, if the golfer maintains the club shaft pushing on the rod 18 in a manner which rotates the plate 16, then the clubhead of the golf club 28 will remain in the plane defined by the rod 18 and the club shaft 26 will have the proper club head orientation. The transverse force indicating device will also enable the golfer to control the amount of transverse force applied during this backswing.

More specifically, in FIG. 2A, the guide rod 18 is initially placed on the right side of the shaft 26 so that a back swing will set the apparatus into a counter-clockwise rotation as viewed by the golfer 24. The initial push by the shaft 26 is directed to the right to obtain maximum rotation of the apparatus. The golfer continues pushing in a rightward direction as the rod 18 rotates by allowing the club shaft to slide along the rod 18. As the back swing progresses, however, the rod 18 will have moved sufficiently far inside that the golfer will be required to move the club shaft 26 to the inside toward the player to keep the club shaft bearing on the rod. Thus, the rotation of the rod 18 provides a guide for the club shaft along a predefined arcuate path.

In FIG. 2B, the plate 16 is shown rotated approximately 90° so that the golfer will be pushing upwards, with the shaft 26 at an angle of about 45° toward the golfer. In the meantime, the guide rod 20, which was oriented horizontally over the golfer's head at address (FIG. 2A), will have moved down and to the left of the golfer.

In FIG. 2C, the position of the golfer and the unattached swing teaching apparatus is shown at the top of the back swing immediately prior to the commencement of the down swing. In order to arrive at this position, the guide rod 18 is rotated by the shaft 26 until the shaft is above the guide rod 18. At the top of the back swing, the swing stops in preparation for the down swing. However, since the guide rod 18 is below the shaft of the golf club, it continues rotating downwardly from the shaft 26 and to the left of the golfer. The rod 20 also continues to rotate while the golfer maintains a static position at the top of the back swing until the guide rod 20 comes in contact with the top of the shaft 26. Thus, the only time that the shaft 26 is not in contact with either the first guide rod 18 or the second guide rod 20 is when the shaft is stationary at the top of the back swing and the golfer is waiting for the rod 20 to come in contact with the shaft and signal the commencement of the down swing. The golfer is, therefore, forced to await and remain stationary at the top of the back swing. This is desirable in order to teach proper timing in swinging a golf club.

As shown in FIGS. 2D through 2F, the initial push of the down swing is directly to the golfer's right. The shaft of the club continues pushing rightward and increasingly downward until the guide rod 20 is approximately vertical at which time the golf club contacts the golf ball. By maintaining the shaft of the golf club in contact with the guide rod 20 for a period of time after the vertical position is reached, a proper follow through can also be achieved.

Referring now to FIG. 4, a second embodiment of the present invention is shown having a housing 52 attached by a support flange 54 to a generally horizontal wall or other solid surface 56. Extending from the end of the housing 52 in substantially horizontal relationship to the support surface 56, is a first shaft 60 to which is fixed a first rotating member 58. In operation, the first rotating member 58 and the first shaft 60 are rotatable relative to the housing 52 and the support surface 56. A second rotating member 62 is rotatably interconnected to the first rotating member 58 by a second shaft 64. Thus, the second rotating member 62 is attached to the second shaft 64 so that both the rotating member 62 and the second shaft 64 rotate together relative to the first rotating member 58.

Attached to the rotating member 62 and extending vertically therefrom is a guide rod means 66 having a vertical leg 68 fixed to the second rotating member 62 and a horizontal leg 70 attached to the end of the vertical leg 68 remote from the second rotating member 62.

In accordance with the second embodiment of the present invention, the golfer 76 or other user stands on a platform 74 and grasps the golf club 28. Attached to the shaft of the golf club and extending downward therefrom is a club extension member 72 which is adapted to sequentially engage the horizontal leg 70 and then the vertical leg 68 of the guide rod means 66 as the club 28 is swung. Of course, it will be appreciated that the club shaft itself, a portion of the user's body, or an extension member attached to the user's body, may be used to engage the guide rod. In the preferred embodiment, the guide rod 66 has two flat surfaces 80 and 82, as illustrated in FIG. 5A. In addition, the club is adapted to be positioned against the flat surface 80 of the guide rod 66 during the initial portion of the back swing and against the flat surface 82 of the guide rod 66 during the portion of the downswing at which the club 28 passes through the hitting region, i.e., when the horizontal leg 70 of the guide rod 66 is substantially horizontal or parallel to the ground.

As shown in FIG. 4, the end of the horizontal leg 70 of the guide rod means 66 extends to pass beneath the feet of the golfer 76 as he is standing on the platform 74. The ball (not shown) could be supported on a high balanced tee which would be knocked over by the horizontal leg 70 after the ball is hit. In operation the flat surface of the club extension 72, the face of the club 28 and the flat surface of the guide rod 66 are aligned so that the face of the club 28 will be in the proper position at the time of ball contact, if the flat surface of the extension portion 72 is held against, and parallel to, the flat surface of the horizontal leg 70.

A counter-rotation means is provided for enabling and preventing rotation of the shafts 60 and 64. The counter-rotation means may, for example, comprise a first rotation assist motor 78 in the housing 52 and a second rotation assist motor 86 in the first rotating member 58, and appropriate associated clutching, gearing and control mechanisms well known in the art.

A second embodiment of the present invention incorporating a transverse force indicating means is illustrated in FIG. 4 where the club extension member 72 rather than the guide rod member 66, is provided with a transverse force indicating means 73. As previously discussed in conjunction with the transverse force indicating means 19 and 21 in FIG. 1, the transverse force indicating means 73 may also comprise a hinge apparatus interconnected between a first section and a second section of a bifurcated club extension member 72 such as that illustrated in FIG. 6, or may comprise a shear member interconnected between a bifurcated club extension member 72 such as that illustrated in FIG. 7, or may comprise a strain gauge apparatus positioned on the surface of the club extension member 72. Of course, it will be appreciated that the transverse force indicating means illustrated in FIGS. 6, 7 and 8 may alternatively be incorporated as part of the club or apparatus being swung, as shown by the indicating means 75 in FIG. 4, the guide rod, or an extension of a body part without departing from the present invention.

Referring now to FIGS. 5A through 5F, at address, the flat surface of the club extension 72 is positioned against and parallel to the flat surface 80 along the horizontal leg 70 of the guide rod means 66. As the back swing commences, the rotation assist motors 78 and 86 commence to assist the guide rod means 66 to swing in a predefined path in response to the swinging of the club 28. Thus, in FIG. 5A, the golfer commences from an initial address position and moves through an arc of approximately 20° to 30 ° to a second position. As the golfer swings the club 28 from the initial position to the second position, the first rotating member 58, the second rotating member 62 and the guide rod 66 rotate together about the first shaft 60. The movement of the guide rod from the initial position to the second position is caused primarily by the club extension 72 as it bears against the horizontal leg 70 of the guide rod means 66.

The proper positioning of the club face will be maintained if the golfer keeps the flat surface of the club extension 72 bearing against the flat surface 80 of the horizontal leg 70. The motor 78 may be incorporated for assisting the guide rod apparatus 66 to rotate about the first shaft 60 in response to the swinging of the club 68. The amount of assistance by the motor may be varied to increase or decrease the load or rotational resistance and thereby provide a means of increasing the power of the golfer's swing.

Referring to FIG. 5B, when the guide rod apparatus 66 reaches the second position, the gearing, clutching and control apparatus operate to cause the first rotating member 58 to reverse its rotational direction to rotate in a clockwise direction as viewed by the golfer. At the same time, the second rotating member 62 commences rotation in the counter-clockwise direction relative to the first rotating member 58 as viewed by the golfer 76. The first rotating member 58 continues its clockwise counter-rotation as the second rotating member 62 continues its counter-clockwise rotation until the guide rod apparatus reaches a third position. In the third position, the first rotating member 58 will have rotated clockwise back to its original position at the time the guide rod apparatus 66 was in its initial position. During the remainder of the back swing from the third position to a fourth position, i.e., the top of the back swing just before commencing the down swing, the rotation of the guide rod means 66 will be about the second shaft 64 with the first rotating member 58 remaining stationary.

Figure 5D:
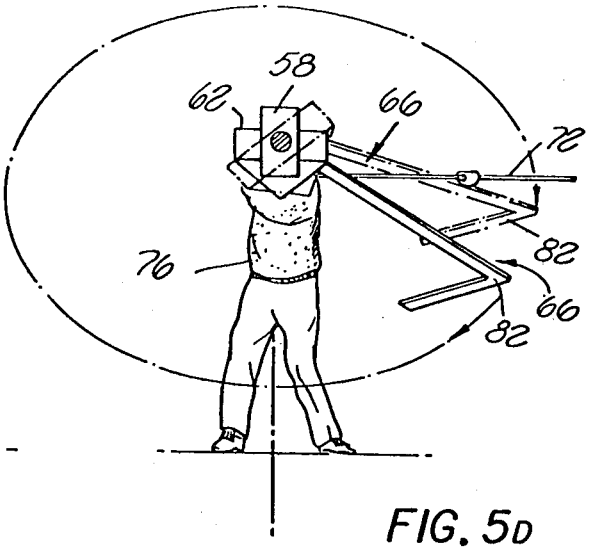

It will be appreciated that as the back swing progresses from its initial position to its fourth position, the contact point of the club extension 72 on the guide rod means 66 moves along the horizontal leg 70 towards the vertical leg 68 and continues to move up the vertical leg 68 as illustrated in FIG. 5C. When the fourth position, i.e., the top of the back swing, is reached, the guide rod means 66 will be in a position underneath the club extension 72 as seen in FIGS. 5C and 5D. Thus, the guide rod means 66 will not be prevented from continuing to rotate even though the swing of the club will have stopped. The golfer 76 maintains his static, cocked position at the top of the back swing while the guide rod assembly 66 continues to rotate about the second shaft 64. Only when the guide rod assembly 66 has rotated through a full circle so that the opposite side 82 of the guide rod apparatus 66 contacts the club extension 72 does the golfer commence his down swing. It will be appreciated that the duration of time that the golfer maintains his static cocked position at the top of the backswing may be varied by placing another L-shaped guide rod at a different location on the second rotating member so that the second L-shaped guide rod contacts the shaft sooner. Of course, both guide rods would preferably be free of the tee at address.

The down swing is essentially the reverse of the back swing. More specifically, as the guide rod apparatus moves from the fourth position back to the third position on the down swing, the rotation will be about the second shaft 64 with the first shaft 60 and the first rotating member 58 remaining stationary. When the third position is reached, the second rotating member 62 continues to rotate in a clockwise direction about the second shaft 64 as viewed by the golfer 76. At the same time, however, the first rotating member 58 commences rotation about the shaft 60 in the counter-clockwise direction (as viewed by the golfer) until the guide rod apparatus reaches the second position. Upon reaching the second position, the rotation of the second rotating member 62 about the second shaft 64 ceases and the direction of rotation of the first rotating member 58 about the first shaft 60 reverses. The guide rod means 66 then rotates about the first shaft 60 down through the first position at which point contact with the ball is made.

Figure 5E:
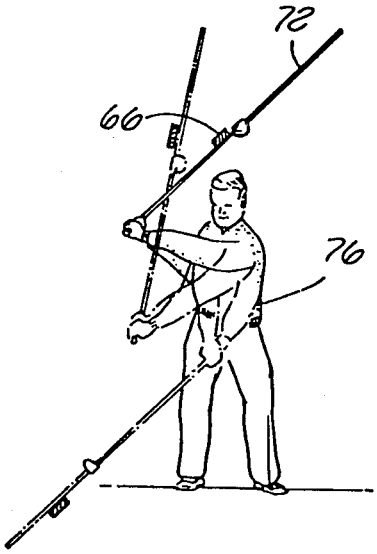
Figure 5F:
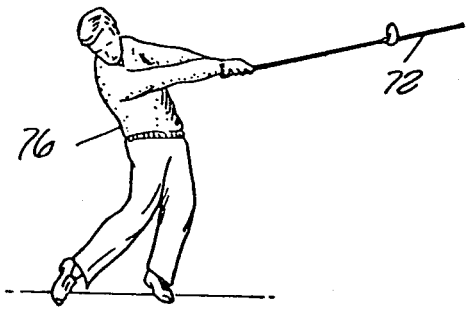

As previously indicated, if the flat surface of the club extension 72 is maintained against the flat surface 82 of the guide rod assembly 66 when contact with the ball is to occur, then the face of the club will be in the proper alignment. FIGS. 5E and 5F show the above sequence as the golfer makes his down swing. After hitting the ball, the club extension 72 may be maintained in contact with the guide rod apparatus 66 with the first rotating member 58 and the second rotating member 62 rotating in an appropriate predefined manner about the first shaft 60 and the second shaft 64 in response to appropriate gearing, clutching and control mechanisms in a manner similar to that previously described. For example, for a running shot the club extension preferably continues to turn (wrists roll over) while for a shot that bites; the contact of the flat surface of the club extension 72 and the flat surface 82 is maintained as long as possible.

Variations in the arrangement and number of guide rods utilized as well as the particular type of counter-rotation means are possible without departing from the spirit of the present invention.

It will be appreciated that the various specific details of the present invention disclosed in conjunction with the description of the embodiments of the present invention have been given by way of illustration only and are not to be taken as or construed in a limiting sense.

What is claimed is:

1. A transverse force indicating apparatus for indicating to a user the magnitude of transverse force exerted during the swinging of a first object, such as a golf club, prior to hitting a second object, such as a ball, comprising:

a shaft having a first part with a gripping means on one end of the first part and a second part with means for contacting the second object attached to one end of the second part, the means for contacting defining a weight concentration;

a shear member interconnecting the other end of the first part and the second part in normally coaxial alignment whereby the second part moves out of coaxial alignment only when the transverse forces exerted against the second part as a sole consequence of swinging the first object prior to hitting the second object are greater than the transverse forces exerted against the first part by a predefined magnitude of force sufficient to cause the shear member to break enabling the second part to move in any noncoaxial direction relative to the first part upon failure of the shear member.

2. A transverse force indicating apparatus for indicating to a user the magnitude of transverse force exerted during the swinging of a golf club before hitting an object comprising:

a shaft having a first part with a gripping means on one end of the first part and a first hole extending axially into the other end of the first part and a second part with a club head defining a weight concentration on one end of the second part to cause variations in moments along the shaft as the club is swung, and having a second hole extending axially into the other end of the second part a shear member extending into the first and second holes for interconnecting the other end of the first part and the other end of the second part in normally coaxial alignment, the second part moving out of coaxial alignment only when the transverse force exerted against the second part as a sole consequence of swinging the golf club before hitting the object is greater than the transverse force exerted against the first part during the swinging of the golf club by a predefined magnitude of force sufficient to cause the shear member to break.

* * * * *